US007547155B2

(12) United States Patent
Windorski

(10) Patent No.: US 7,547,155 B2
(45) Date of Patent: Jun. 16, 2009

(54) MARKING DEVICE

(75) Inventor: David C. Windorski, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 166 days.

(21) Appl. No.: 11/532,173

(22) Filed: Sep. 15, 2006

(65) Prior Publication Data

US 2008/0069627 A1 Mar. 20, 2008

(51) Int. Cl.
*B43K 29/00* (2006.01)

(52) U.S. Cl. ..... 401/195; 401/202; 401/243

(58) Field of Classification Search ..... 401/195, 401/202, 52, 213, 243
See application file for complete search history.

(56) References Cited

U.S. PATENT DOCUMENTS

| | | | | |
|---|---|---|---|---|
| 1,555,737 | A | 10/1915 | Kinzie | |
| 1,173,843 | A | 2/1916 | Morten | |
| 3,691,140 | A | 9/1972 | Silver | |
| 3,857,731 | A | 12/1974 | Merrill, Jr. et al. | |
| 4,166,152 | A | 8/1979 | Baker et al. | |
| D268,501 | S | 4/1983 | Kruckel et al. | |
| 4,416,392 | A | 11/1983 | Smith | |
| 4,495,318 | A | 1/1985 | Howard | |
| 4,770,320 | A | 9/1988 | Miles et al. | |
| 4,781,306 | A | 11/1988 | Smith | |
| D309,913 | S | 8/1990 | Shintani | |
| 4,963,048 | A | 10/1990 | Thomas et al. | |
| 5,033,895 | A * | 7/1991 | Aida | 401/131 |
| 5,045,569 | A | 9/1991 | Delgado | |
| 5,073,457 | A | 12/1991 | Blackwell | |
| D330,912 | S | 11/1992 | Otake | |
| 5,299,712 | A | 4/1994 | Carlson et al. | |
| 5,417,345 | A | 5/1995 | Smith | |
| 5,571,617 | A | 11/1996 | Cooprider et al. | |
| 5,663,241 | A | 9/1997 | Takamatsu et al. | |
| 5,714,237 | A | 2/1998 | Cooprider et al. | |
| 5,756,625 | A | 5/1998 | Crandall et al. | |
| 5,824,748 | A | 10/1998 | Kesti et al. | |
| D419,601 | S | 1/2000 | Windorski | |
| D428,926 | S | 8/2000 | Windorski | |
| RE37,563 | E | 2/2002 | Cooprider et al. | |
| 6,354,754 | B1 * | 3/2002 | Pan | 401/195 |
| 6,719,472 | B2 | 4/2004 | Windorski et al. | |
| D502,740 | S | 3/2005 | Stoddard et al. | |
| 6,921,223 | B2 | 7/2005 | Marschand | |
| D508,718 | S | 8/2005 | Hsu | |
| 6,935,801 | B1 | 8/2005 | Kuo | |
| 6,981,813 | B1 * | 1/2006 | Thomas | 401/195 |
| 2004/0234326 | A1 * | 11/2004 | Erlebacher et al. | 401/195 |
| 2005/0058497 | A1 | 3/2005 | Marschand | |

(Continued)

FOREIGN PATENT DOCUMENTS

| | | |
|---|---|---|
| JP | 11-139081 | 5/1999 |

(Continued)

*Primary Examiner*—David J Walczak
(74) *Attorney, Agent, or Firm*—Robert H. Jordan

(57) ABSTRACT

A marking device includes at least one writing instrument and a cap. The cap defining a writing instrument receiving portion and a sheet dispensing portion. The writing instrument receiving portion is inseparable from the sheet dispensing portion. A substantially flat stack of sheet material is releasably retained in the dispensing portion.

14 Claims, 10 Drawing Sheets

U.S. PATENT DOCUMENTS

| | | | | |
|---|---|---|---|---|
| 2005/0100313 | A1* | 5/2005 | Wang | 386/46 |
| 2005/0111904 | A1 | 5/2005 | Windorski et al. | |
| 2005/0150993 | A1* | 7/2005 | Flis | 242/566 |
| 2005/0191114 | A1 | 9/2005 | Smith, Jr. et al. | |
| 2005/0254883 | A1* | 11/2005 | Fielding | 401/195 |

FOREIGN PATENT DOCUMENTS

| | | |
|---|---|---|
| WO | WO 01/05680 | 1/2001 |
| WO | WO 2004/082962 | 9/2004 |
| WO | WO 2005/032846 | 4/2005 |
| WO | WO 2005/070700 | 8/2005 |

* cited by examiner

MARKING DEVICE

BACKGROUND

The present invention relates to devices for marking written or pictorial materials that may be deemed important to a person viewing such materials. In particular, the present invention relates to a device that incorporates a writing instrument and a sheet material dispenser for individually dispensing sheet material formed in a stack.

In the course of reviewing and studying printed materials, it is common for individuals to mark portions of the materials deemed important. The materials may be marked by writing marginal notes, underlining text and even highlighting portions of the materials. As one example, students commonly use writing instruments such as highlighter pens and/or colored pens or pencils to aid in studying course materials. In addition, the materials may be marked by the use of sheet material, for example repositionable tape flags such as those manufactured by 3M Company, St. Paul, Minn., under the trade designation Post-it® flags. Repositionable tape flags may be used to quickly locate or identify particular pages or passages of the printed material, such as a portion of the material that has been highlighted. For ease and convenience of access to both a writing instrument and tape flags or the like, it would be beneficial to house both in a single, easy to carry unit that is also not unattractive or unpleasing to the professional eye.

SUMMARY

One aspect of the invention described herein provides a marking device. In one embodiment according to the invention, the marking device comprises: at least one writing instrument; a cap defining a writing instrument receiving portion and a sheet dispensing portion, the writing instrument receiving portion inseparable from the sheet dispensing portion; and a substantially flat stack of sheet material releasably retained in the dispensing portion.

Another aspect of the invention described herein provides a cap for a writing instrument. In one embodiment according to the invention, the writing instrument comprises a body having a tip receiving portion and a sheet dispensing portion, wherein the tip receiving portion is configured to receive a tip of at least one writing instrument, and wherein the sheet dispensing portion is configured to receive a substantially flat stack of sheet material.

BRIEF DESCRIPTION OF THE DRAWINGS

The present invention will be further described with reference to the accompanying drawings wherein like reference numerals refer to like parts in the several views, and wherein.

DETAILED DESCRIPTION

Figure 1:
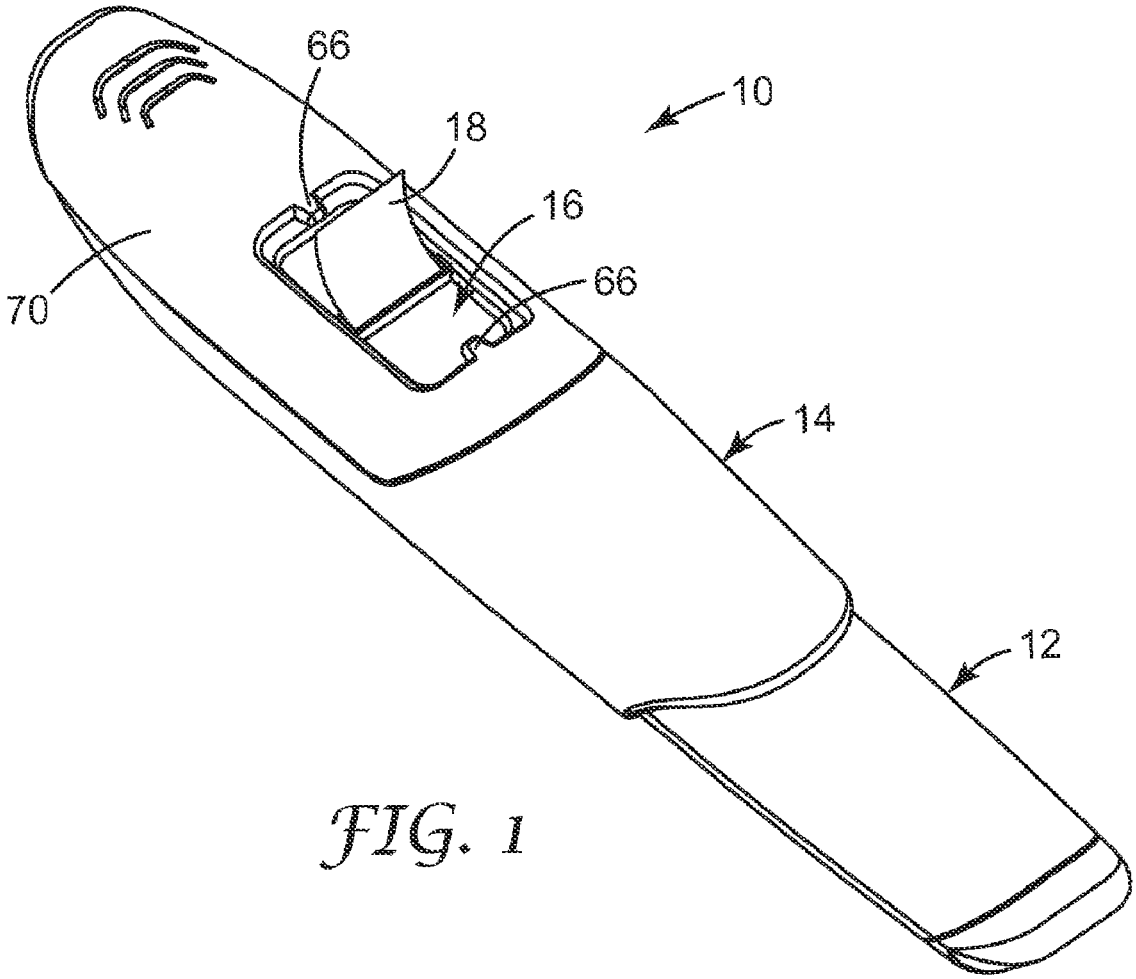
FIG. 1 is a perspective illustration of one embodiment of a marking device according to the invention.

In the following Detailed Description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Referring now to FIGS. 1-6, there is shown one embodiment of a marking device 10 according to the present invention. Marking device 10 includes a writing instrument 12, a cap 14, and a stack 16 of sheet material 18 (also referred to herein simply as sheets 18). As best seen in the cross-sectional illustration of FIG. 6, cap 14 includes a writing instrument receiving portion 20 and a sheet dispensing portion 22 inseparable from the writing instrument receiving portion 20. Writing instrument receiving portion 20 is configured to receive and releasably retain writing instrument 12. Sheet dispensing portion 22 is configured to receive substantially flat stack 16 of sheets 18 and dispense individual ones of sheets 18.

Figure 2:
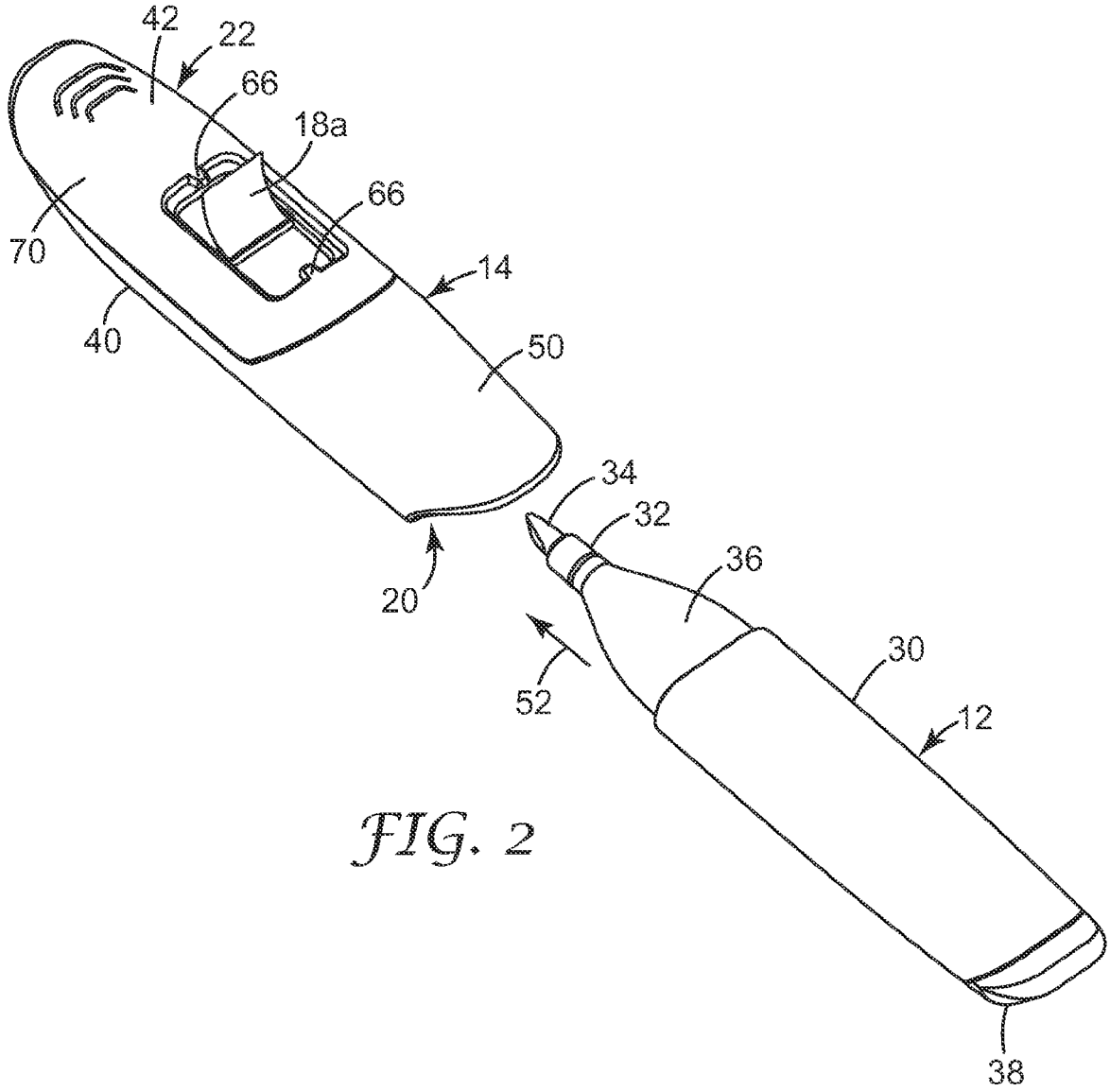
FIG. 2 is a perspective illustration of the marking device of FIG. 1, showing the writing instrument disengaged from the cap.

Referring now to FIG. 2, writing instrument 12 may be any type of writing instrument known in the art. For example and without limitation, writing instrument 12 may be a highlighter, a pen, a dry-erase marker, a permanent marker, a pencil, or any other type of instrument for marking a surface. Writing instrument 12 is constructed using methods and materials known in the art, and includes a body 30 having at one end a tip portion 32 with a marking element 34 for applying a mark (e.g., ink, lead, fluid or other marking material as appropriate for the particular writing instrument 12) to a surface (e.g., a page in a document). In one embodiment, a grip portion 36 adjacent tip portion 32 is shaped or contoured to improve the ability of a user to grasp and use writing instrument 12. Body 30 may include indicia to indicate to a user the type of writing instrument (e.g., whether writing instrument 12 is a highlighter, pen or pencil, or the color of ink in writing instrument 12). For example, all or a portion of body 30 may include color indicia to indicate the type of writing instrument 12. In one embodiment, an end portion 38 of body 30 opposite tip portion 32 is colored to indicate the type of writing instrument 12. In another embodiment, end portion 38 incorporates a second marking element (not shown) in writing instrument 12. For example, marking element 34 at tip portion 32 may comprise a highlighter, while another marking element such as a pen or differently colored highlighter may be presented at end portion 38. A writing instrument having two marking elements at opposite ends thereof is referred to herein as a "double" marking instrument.

Figure 4:
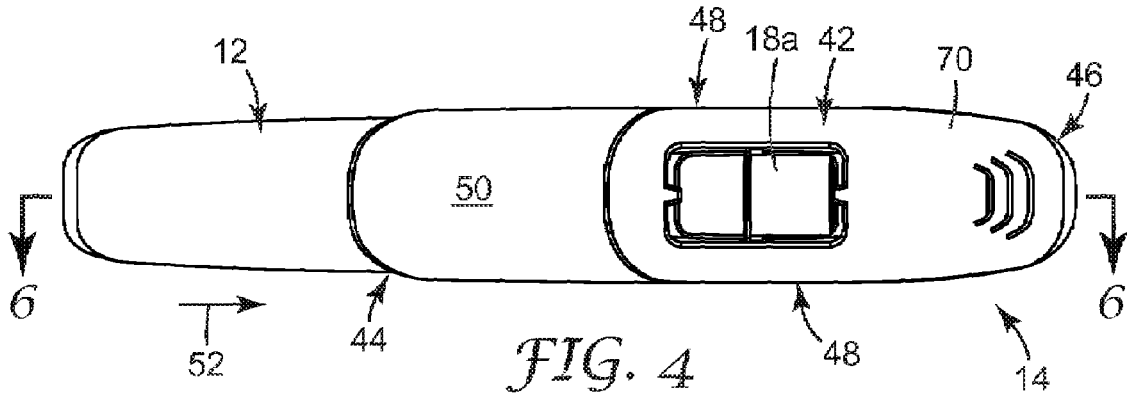
FIG. 4 is a top plan illustration of the marking device of FIG. 1.
Figure 5:
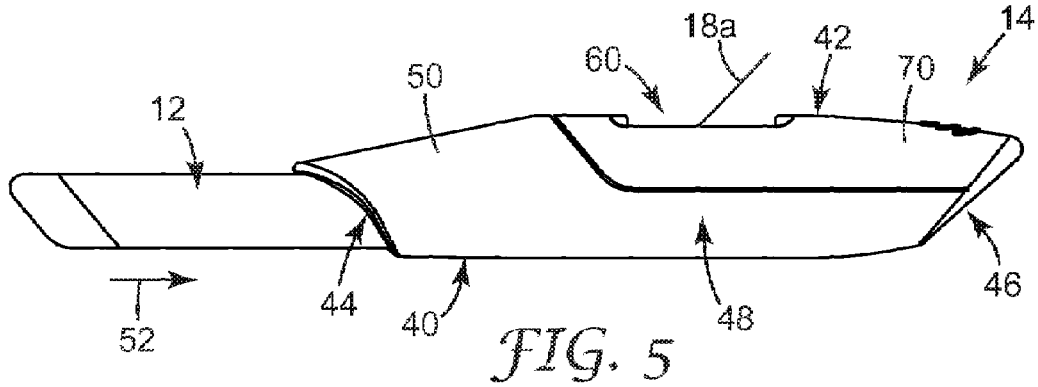
FIG. 5 is a side elevation illustration of the marking device of FIG. 1.
Figure 6:
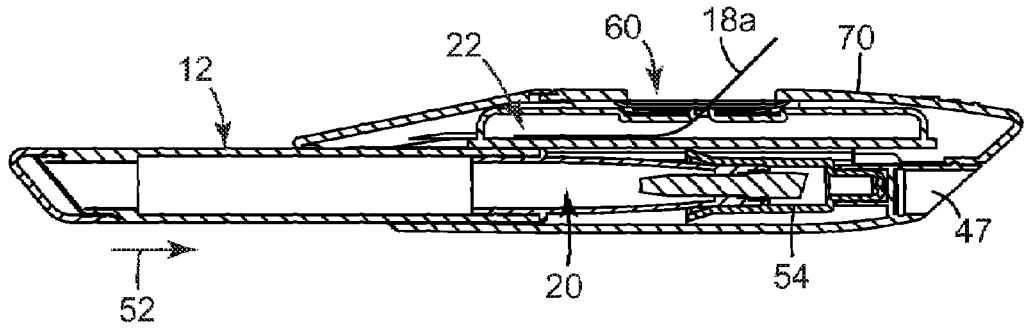
FIG. 6 is a cross-sectional illustration of the marking device of FIG. 4, taken along line 6-6 in FIG. 6.
Figure 7:
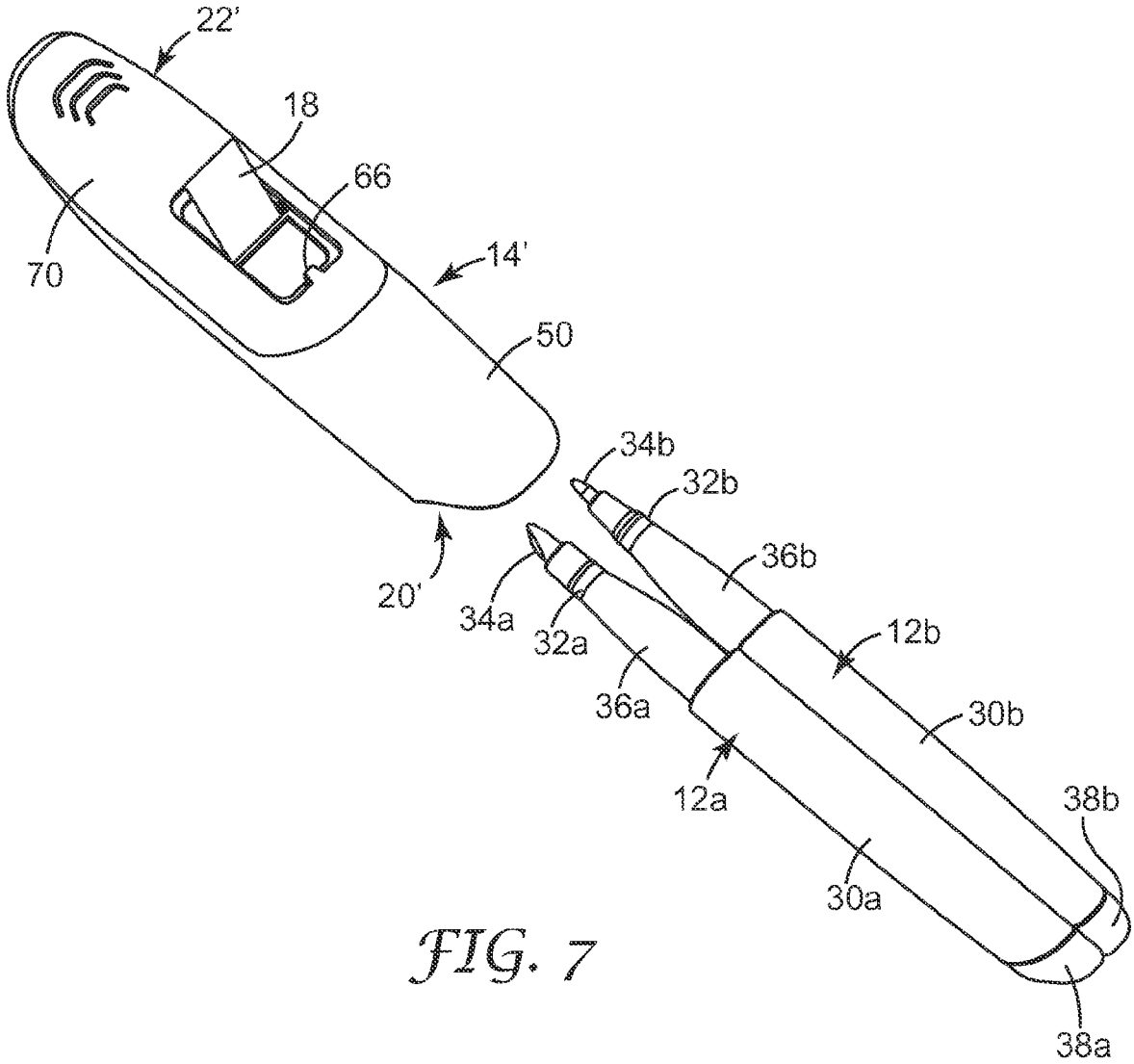
FIG. 7 is a perspective illustration of another embodiment of a marking device according to the invention, showing two writing instruments disengaged from the cap.

As best seen in FIGS. 4-6, cap 14 includes bottom surface 40, top surface 42, open end 44, closed end 46, and opposed longitudinal sides 48. Writing instrument receiving portion 20 is positioned adjacent bottom surface 40, and sheet dispensing portion 22 is positioned adjacent top surface 42. As will be evident, the positioning of writing instrument receiving portion 20 and sheet dispensing portion 22 adjacent opposed bottom and top surfaces 40, 42, respectively, of cap 14 is beneficial in the use of marking device 10. Specifically, with or without writing instrument 12 engaged with writing instrument receiving portion 20, bottom surface 40 may be laid on a support surface (i.e., a desk or table) with top surface 42 facing upward (e.g., away from the support surface), such that sheet dispensing portion 22 is easily accessible by the user. In one embodiment, bottom surface 40 is shaped to prevent cap 14 from substantial rocking or rolling movement when bottom surface 40 is laid on a support surface. For example, all or portions of bottom surface 40 may be substantially flat. In one embodiment, top surface 42 is contoured to provide a shape that transitions in an aesthetically pleasing manner from closed end 46 to open end 44 that receives writing instrument 12.

In one embodiment, closed end 46 defines an attachment point 47 (FIG. 6). In the illustrated embodiment, attachment point 47 comprises a cavity configured to receive and retain a mating plug attached to, for example, a lanyard or a pocket clip (not shown), such as by press fit or snap fit.

All or at least a portion of the outer surface of cap 14 is suitable for receiving printed indicia thereon. In one embodiment, at least top surface 42 includes an imprint area 50 suitable for receiving printed indicia. Printed indicia may include any desired graphic or text, for example, a name, logo, phone number, address, web site, etc. In one embodiment, imprint area 50 is positioned on cap 14 such that imprint area 50 is easily and frequently viewed. For example, imprint area 50 may be on top surface 42 such that imprint area 50 is presented to the user when cap 14 is laid on a support surface. In this manner, marking device 10 is particularly useful as a promotional item that may be given away to consumers, such as at trade shows, conferences, and the like. In one embodiment, at least the portions of cap 14 intended to receive printed indicia are formed of a material suitable for receiving printed indicia. One exemplary material suitable for receiving printed indicia is acrylonitrile butadiene styrene (ABS).

Writing instrument receiving portion 20 receives writing instrument 12 into open end 44 in the longitudinal direction (i.e., the direction of arrow 52). In particular, writing instrument receiving portion 20 is configured to releasably engage tip portion 32 of body 30 to cover an exposed portion of marking element 34 when writing instrument 12 is not being used (i.e., is being stored). In one embodiment, writing instrument receiving portion 20 of cap 14 includes an elongated barrel portion 54 that slidably receives tip portion 32 therein (best seen in FIGS. 3 and 6). Tip portion 32 of writing instrument 12 may be retained by, for example, snap fit or friction fit as is known in the art. In one embodiment, open end 44 of cap 14 and end portion 38 of writing instrument 12 are formed with complimentary mating shapes, such that cap 14 may be stored on end portion 38 of writing instrument 12 when writing instrument 12 is being used.

In one embodiment, when writing instrument 12 utilizes a marking fluid (e.g., a highlighter, marker or ink pen), body 30 of writing instrument 12 and barrel portion 54 of cap 14 are formed of a material that provides a suitable vapor barrier for the marking fluid to prevent evaporation of the marking fluid. One exemplary material suitable as a vapor barrier is polypropylene. In one embodiment, barrel portion 54 is formed of a suitable vapor barrier material while at least the outer surfaces of cap 14 are formed of a different material suitable for receiving printed indicia thereon. Barrel portion 54 is then retained in cap 14 by press fit, snap fit, adhesive, ultrasonic welding, overmolding, or other suitable retaining means.

In another embodiment writing instrument receiving portion 20 is configured to receive more than one writing instrument 12 into open end 44 of cap 14. In the embodiment of FIGS. 7-11, a cap 14' having a writing instrument receiving portion 20' is configured to receive two writing instruments 12*a*, 12*b*. In the illustrated embodiment of FIGS. 7-11, writing instruments 12*a*, 12*b*, when positioned adjacent each other, form a combined shape similar to the single writing instrument 12 of FIGS. 1-6. In other embodiments, writing instruments 12*a*, 12*b* may have other shapes than those illustrated. For example, writing instruments may be substantially cylindrical in transverse cross-section. Writing instruments 12*a*, 12*b* may be any type of writing instruments known in the art. For example and without limitation, writing instruments 12*a*, 12*b* may be highlighters, pens, markers, pencils, or any combination thereof. In one embodiment, at least one of writing instruments 12*a*, 12*b* is a highlighter. Writing instruments 12*a*, 12*b* are constructed using methods and materials known in the art, and include a body 30*a*, 30*b*, respectively. Bodies 30*a*, 30*b* have respective tip portions 32*a*, 32*b*, with associated marking elements 34*a*, 34*b* for applying a mark (e.g., ink, lead, or other marking material as appropriate for the particular writing instrument) to a surface (e.g., a page in a document). Bodies 30*a*, 30*b* may be provided with respective grip portions 36*a*, 36*b* that are shaped or contoured to improve the ability of a user to grasp and use the writing instruments. Bodies 30*a*, 30*b* may include indicia to indicate to a user the type of writing instrument (e.g., whether the writing instrument is a highlighter, pen or pencil, or the color of ink in the writing instrument). In one embodiment, end portion 38*a*, 38*b* of bodies 30*a*, 30*b* are colored to indicate the type of writing instrument. One or both of writing instruments 12*a*, 12*b* may comprise a "double" marking instrument as described above.

Writing instrument receiving portion 20' of cap 14' is constructed similarly to receiving portion 20 of cap 14 described above, but includes two elongated barrel portions 54*a*, 54*b* (FIGS. 8 and 11) that slidably receive tip portions 32*a*, 32*b*, respectively, of writing instruments 12*a*, 12*b* in the above-described manner. Dispensing portion 22' of cap 14' is constructed similarly to dispensing portion 22 of cap 14. Accordingly, only dispensing portion 22 of cap 14 is described below, with the understanding that dispensing portion 22' of cap 14' is similarly constructed.

Referring again to FIGS. 1-7, sheet dispensing portion 22 of cap 14 defines a compartment 60 for receiving stack 16 of sheets 18. A window 62 having perimeter 64 extends into compartment 60 through top surface 42. The top sheet 18*a* from stack 16 extends from compartment 60 through window 62, such that the extended top sheet 18*a* may be withdrawn by the user. In one embodiment, at least one sheet material retaining tab 66 extends from perimeter 64 of window 62 to retain top sheet 18*a* below top surface 42 when the user desires (i.e., when not using marking device 10). In particular, the user may simply push down on top sheet 18*a* to bend top sheet 18*a* and place the free end under retaining tab 66. To release top sheet 18*a*, the user simply presses down, pulls the sheet away from retaining tab 66 and the free end will flip up. In one embodiment, retaining tabs 66 are provided at opposite ends of window 62, such that top sheet 18*a* may be retained under either one of retaining tabs 66. In some embodiments, when extended, top sheet 18*a* may be preferentially inclined toward one end of window 62, such that the extended top sheet 18*a* is more easily inserted under one of the retaining tabs 66. In other embodiments, retaining tabs 66 can be positioned anywhere around perimeter 64 of window 62, including on the longitudinal side surfaces of window 62. In addition, retaining tabs 66 may have shapes and sizes other than that illustrated, and may, for example, extend around a portion or all of perimeter 64. Use of retaining tabs 66 prevents damage to the top sheet 18*a* when marking device 10 is, for example, in a pocket, briefcase, or backpack.

In one embodiment, compartment 60 is accessible via a cover 70 moveable between an open position (FIG. 3) and a closed position (FIG. 2). In the illustrated embodiment, in the open position cover 70 is completely detached from cap 14. However, in other embodiments, cover 70 may remain attached to cap 14, such a by a hinge mechanism. As shown in the Figures, in one embodiment, cover 70 includes window 62.

Figure 3:
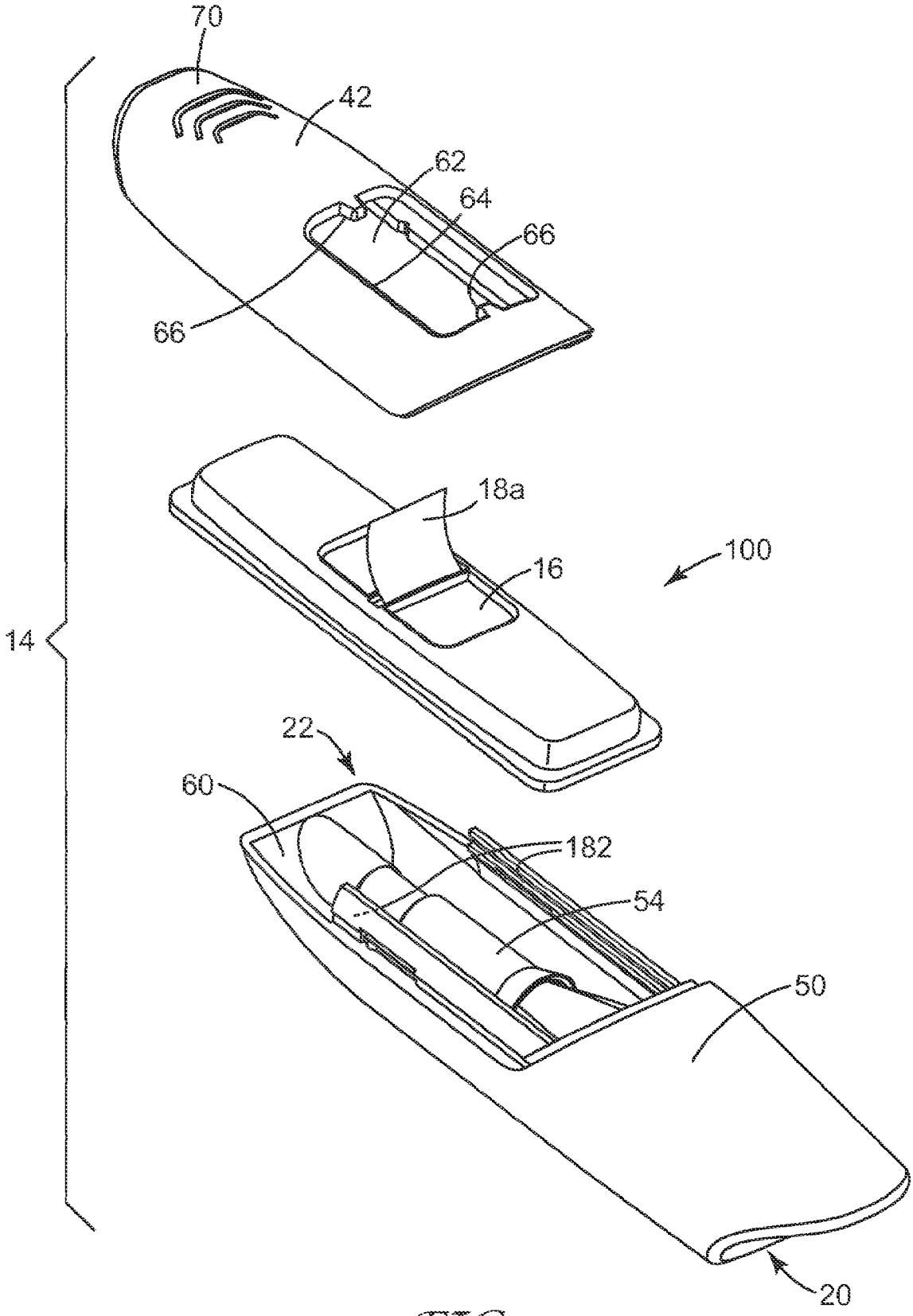
FIG. 3 is a perspective partially exploded illustration of the marking device cap of FIG. 2, showing the stack of sheet material contained in the cap.

Referring to FIG. 3, when cover 70 is in the open position, the stack 16 of sheets 18 may be inserted into compartment 60. When all sheets 18 have been dispensed, sheet dispensing portion 22 may be refilled with a replacement stack of sheet material. The replacement stack of sheet material may be identical to the previous stack of sheet material, or may be different in color, indicia, etc., from the previous stack of sheet material. To install the initial stack 16 of sheet material 18, or to replace a depleted stack 16 of sheet material 18, a user first moves cover 70 of cap 14 from the closed position (FIG. 2) to the open position (FIG. 3) to thereby open the compartment 60 of dispensing portion 22. The user then removes components of the previous stack of sheet material (if any) from compartment 60. Depending upon the construction of stack 16, components of the previous stack of sheet material may or may not be present. The user then aligns and inserts the new/replacement stack of sheet material into the compartment, and moves cover 70 from the open position to the closed position, thereby enclosing the new/replacement stack of sheet material within the compartment. The free end of the top sheet 18*a* of stack 16 is drawn through window 62 for subsequent dispensing.

A typical manner of packaging sheet material formed in a stack and adhered together with a releasable adhesive layer along alternating opposing edges, e.g., in a fan-fold or Z-fold manner, is disclosed in U.S. Pat. No. 4,770,320, which is incorporated by reference herein in its entirety. Various other dispensable sheet material stacks are known in the art, including those disclosed in U.S. Pat. Nos. 4,416,392, 4,781,306, and 5,417,345, which are also incorporated herein by reference.

As is generally known in the art, sheets 18 may comprise sheets of paper, plastic, or other suitable material having an adhesive portion and a non-adhesive portion. The sheets may be any desired color or combination of colors, may be opaque, transparent, or translucent, or a combination thereof, and may include any desired indicia or message thereon.

Figure 12A:
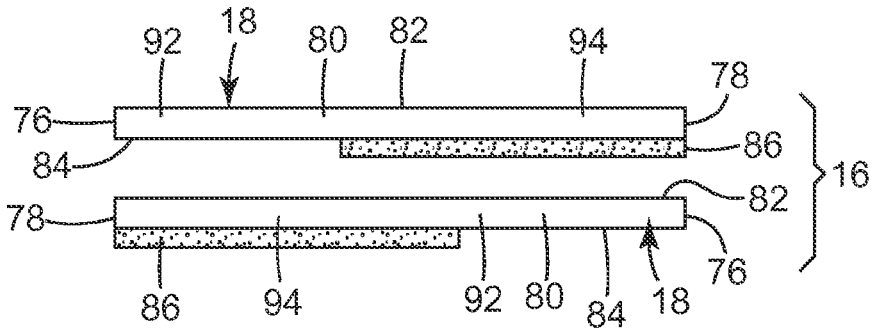
FIG. 12A is a side elevation illustration of a first embodiment of sheet material for use in the marking device according to the invention.
Figure 12B:
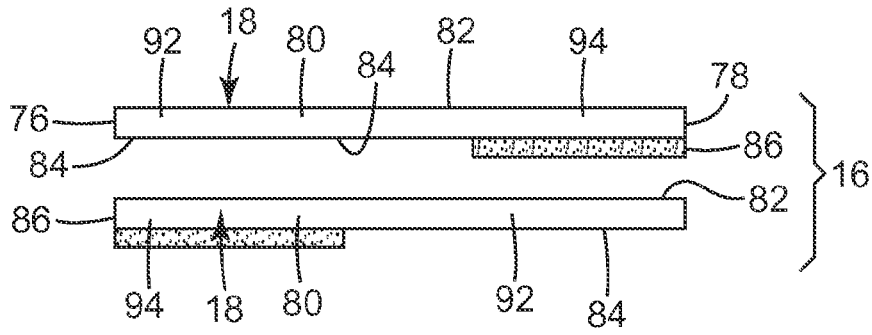
FIG. 12B is a side elevation illustration of a second embodiment of sheet material for use in the marking device according to the invention.
Figure 13:
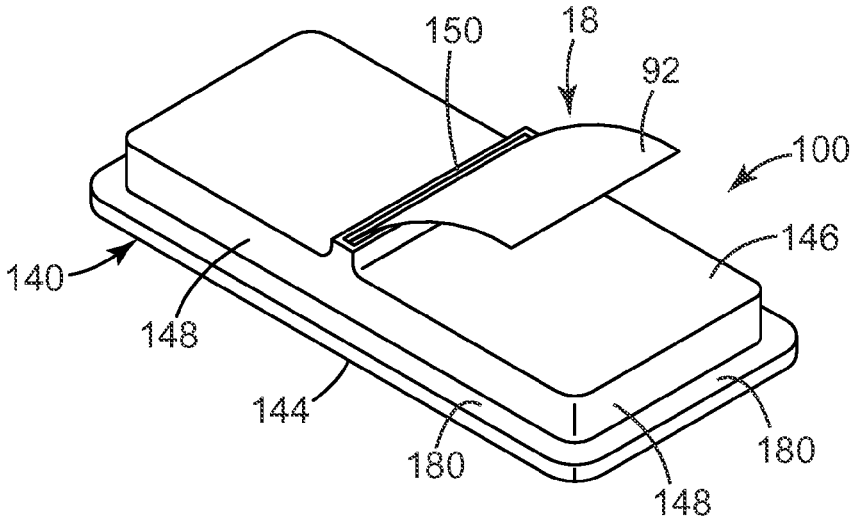
FIG. 13 is a perspective view of one embodiment of a dispenser package for holding a stack of sheet material according to the invention.
Figure 14:
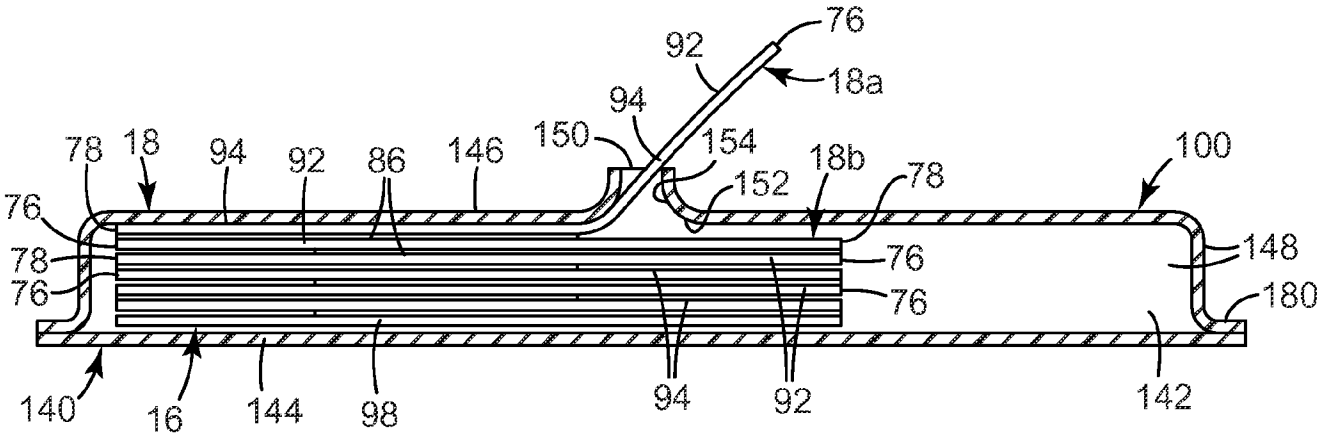
FIGS. 14 through 17 are sectional side views of the dispenser package of FIG. 13, sequentially illustrating a sheet being pulled from the dispenser package.
Figure 15:
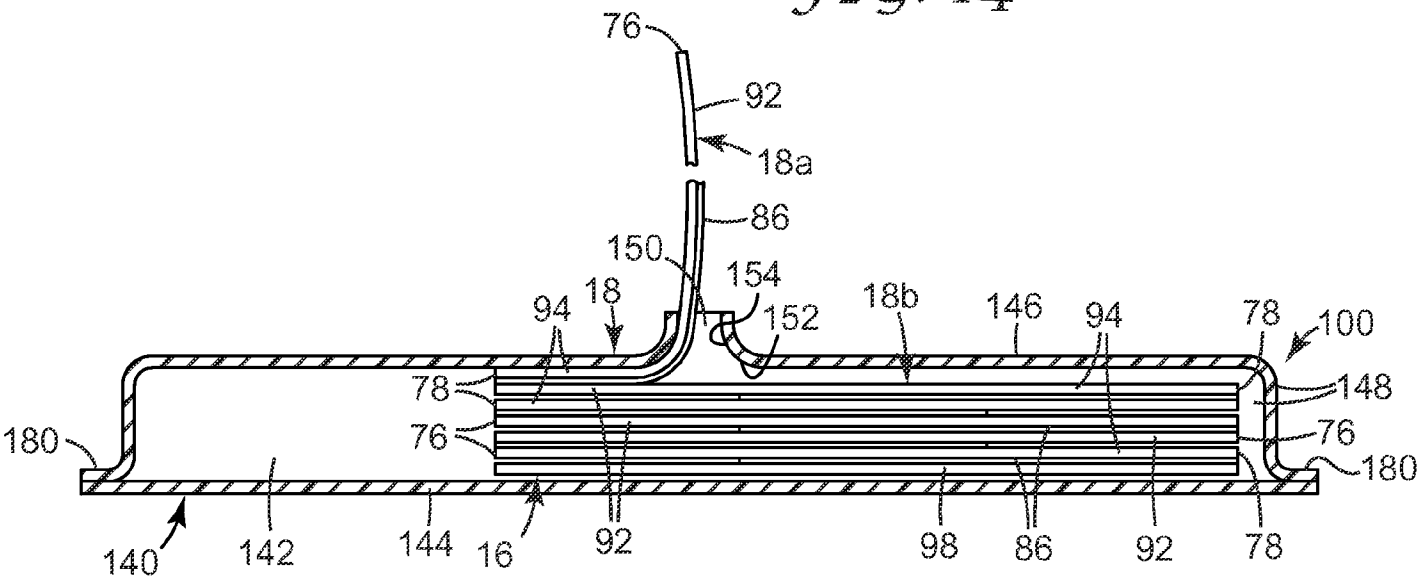
Figure 16:
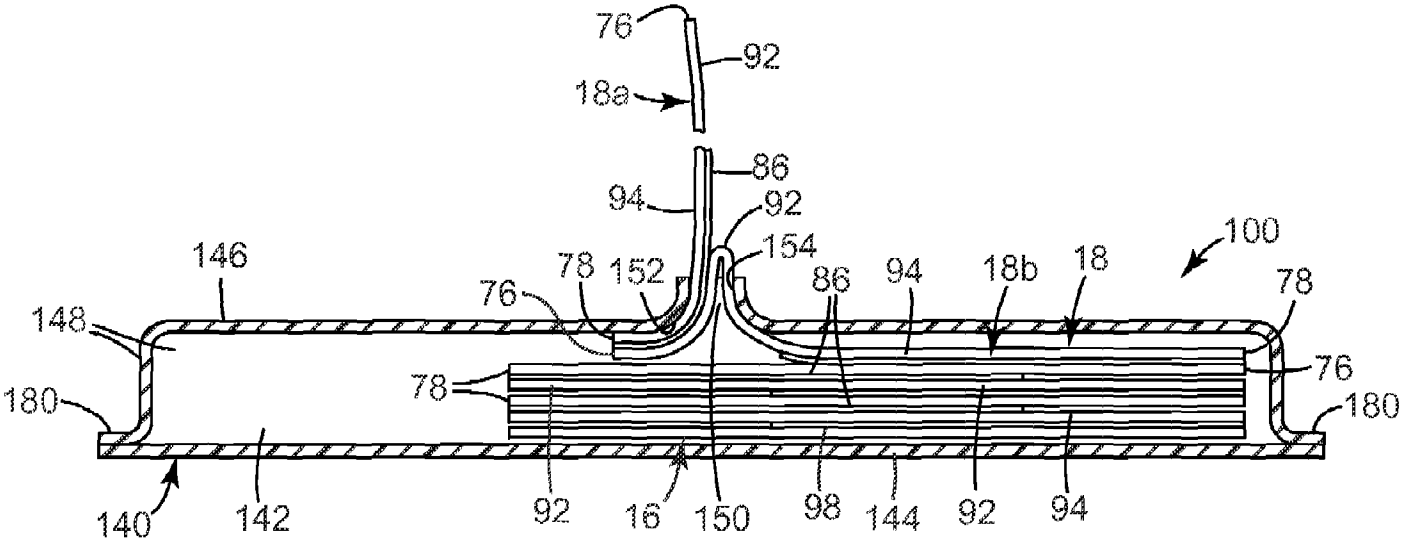
Figure 17:
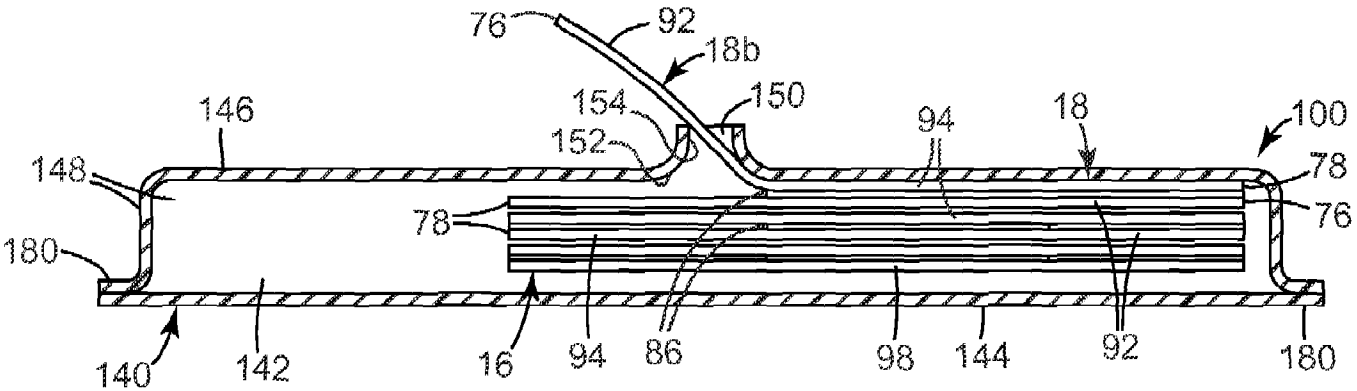

FIGS. 12A and 12B illustrate exemplary embodiments of the sheets 18 that may be used to form the stack 16, where like elements are similarly numbered. In FIGS. 12A and 12B, only two of the sheets 18 from the stack 16 are shown, and the sheets 18 are aligned with respect to each other as they are in the stack 16 but slightly separated for clarity concerning the portions of the sheets 18. Each of the sheets 18 comprises a rectangular member having first and second opposite ends 76 and 78 and a predetermined length between its first and second ends 76 and 78, and comprises a backing 80 having opposite major top and bottom side surfaces 82 and 84. The backing 80 comprises any suitable material, including paper and polymeric materials. In one embodiment, backing 80 comprises a substantially transparent flexible polymeric material such as polyester. In one embodiment, backing 80 is a 2.4 mil thick polyester. A layer of pressure sensitive adhesive 86 is on bottom surface 84 of backing 80. The sheets 18 are releasably adhered to each other by releasable adhesion of the layers of pressure sensitive adhesive 86 to the top surfaces 82 of underlying sheets 18 to form the stack 16 with adjacent ends 76 or 78 of the sheets 18 aligned and with the first and second ends 76 and 78 of successive sheets 18 in the stack 16 being adjacent.

Various repositionable adhesives can be used. Suitable repositionable adhesives are disclosed in U.S. Pat. No. 3,691,140 (Silver); U.S. Pat. No. 3,857,731 (Merrill et al.); U.S. Pat. No. 4,166,152 (Baker et al.); U.S. Pat. No. 4,495,318 (Howard); U.S. Pat. No. 5,045,569 (Delgado); U.S. Pat. No. 5,073,457 (Blackwell) and U.S. Pat. No. 5,571,617 (Cooprider et al.), U.S. Pat. No. 5,663,241 (Takamatsu et al.); U.S. Pat. No. 5,714,237 (Cooprider et al.); U.S. RE 37,563 (Cooprider et al.); and U.S. Pat. No. 5,756,625 (Crandall et al.) and U.S. Pat. No. 5,824,748 (Kesti et al.). The repositionable adhesive can be solvent based, or water based.

Referring to the exemplary sheet embodiment of FIG. 12A, each of the sheets 18 includes a layer 86 of pressure sensitive adhesive on at least a second end portion 94 of the bottom surface 84 adjacent the second end 78 of the backing 80. The sheets 18 in the stack 16 are releasably adhered to each other by adhesion of the layers of pressure sensitive adhesive 86 to portions of the top surfaces of underlying sheets 18 adjacent the first ends 76 of the underlying sheets 18 to form the stack 16, with adjacent ends 76 and 78 of the sheets 18 aligned and with the first and second ends 76 and 78 of successive sheets 18 in the stack 16 being adjacent. In the illustrated embodiment, the second end portion 94 has a length from the second end 78 of the backing 80 toward its first end 76 that is longer than half the predetermined length of the backing 80. In FIG. 12B, the second end portion 94 has a length from the second end 78 of the backing 80 toward its first end 76 that is shorter than half the predetermined length of the backing 80.

In the sheets 18 illustrated in FIGS. 12A and 12B, the pressure sensitive adhesive in the layers 86 is repositionable, and the first end portions 92 of the sheets 18 are configured to prevent or reduce adhesion of the first end portions 92 of the sheets 18 adjacent their first ends 76 to an underlying sheet 18. In some embodiments, the first end portion 92 is smaller in area than the second end portion 94, while in other embodiments the first end portion 92 is larger in area than the second end portion 94. In some embodiments, the first end portion 92 is printed with a bright colored ink (e.g., red, green or yellow)

to make it visually distinctive; while the adhesive coated second end portion 94 is generally transparent when adhered to a substrate so that it will not obscure a substrate to which it is attached. Also, preferably the top side surface 82 opposite the coating adhesive 86 is adapted to be written on by methods known in the art.

Referring now to FIGS. 14-17, in one embodiment the stack 16 of sheets 18 is supported on a carrier member 98. A lowermost sheet 18 of stack 16 is adhered or otherwise fixed to carrier member 98 to restrict endwise movement of stack 16 relative to the carrier member 98, and to restrict flexing of the second end portions 94 of all but the uppermost sheet 18*a* in the stack 16 around an axis parallel to the ends 76, 78 of the sheets 18 in the stack 16. In one embodiment, the carrier member 98 is substantially flat. In another embodiment, the carrier member 98 is configured to bias or urge the stack 16 upward (toward the uppermost sheet 18*a*).

In one embodiment, the stack 16 of sheet material 18 is contained in a dispenser package. An exemplary dispenser package is described in U.S. Pat. No. 4,770,320, which is incorporated by reference herein in its entirety. Referring to FIGS. 13-17, an exemplary dispenser package 100 having stack 16 of sheet material therein is illustrated. The dispenser package 100 includes an enclosure 140 comprising walls defining a chamber 142 in which the carrier member 98 with stack 16 secured thereto is positioned. Those walls include a bottom wall 144, a top wall 146 opposite the bottom wall 144, and upstanding side walls 148 extending between the bottom walls 144 and top wall 146. The top wall 146 defines a top side of the chamber 142, and further defines a generally central transverse slot 150 substantially parallel to the first and second ends 76, 78 of the sheets 18. In one embodiment, slot 150 comprises opposed parallel cylindrically convex guide surface portions 152 adjacent stack 16 leading to opposed parallel planar guide surface portions 154 extending at substantially a right angle to the major portion of the surface of top wall 146. Guide portions 152, 154 insure that the second end portions 94 of sheets 18 being pulled from stack 16 will be peeled away from the subsequent sheet, thereby reducing curl in sheets 18. Further, the spacing between opposed guide surface portions 152, 154 helps prevent more than one sheet 18 at a time from being pulled through slot 150.

Figure 8:
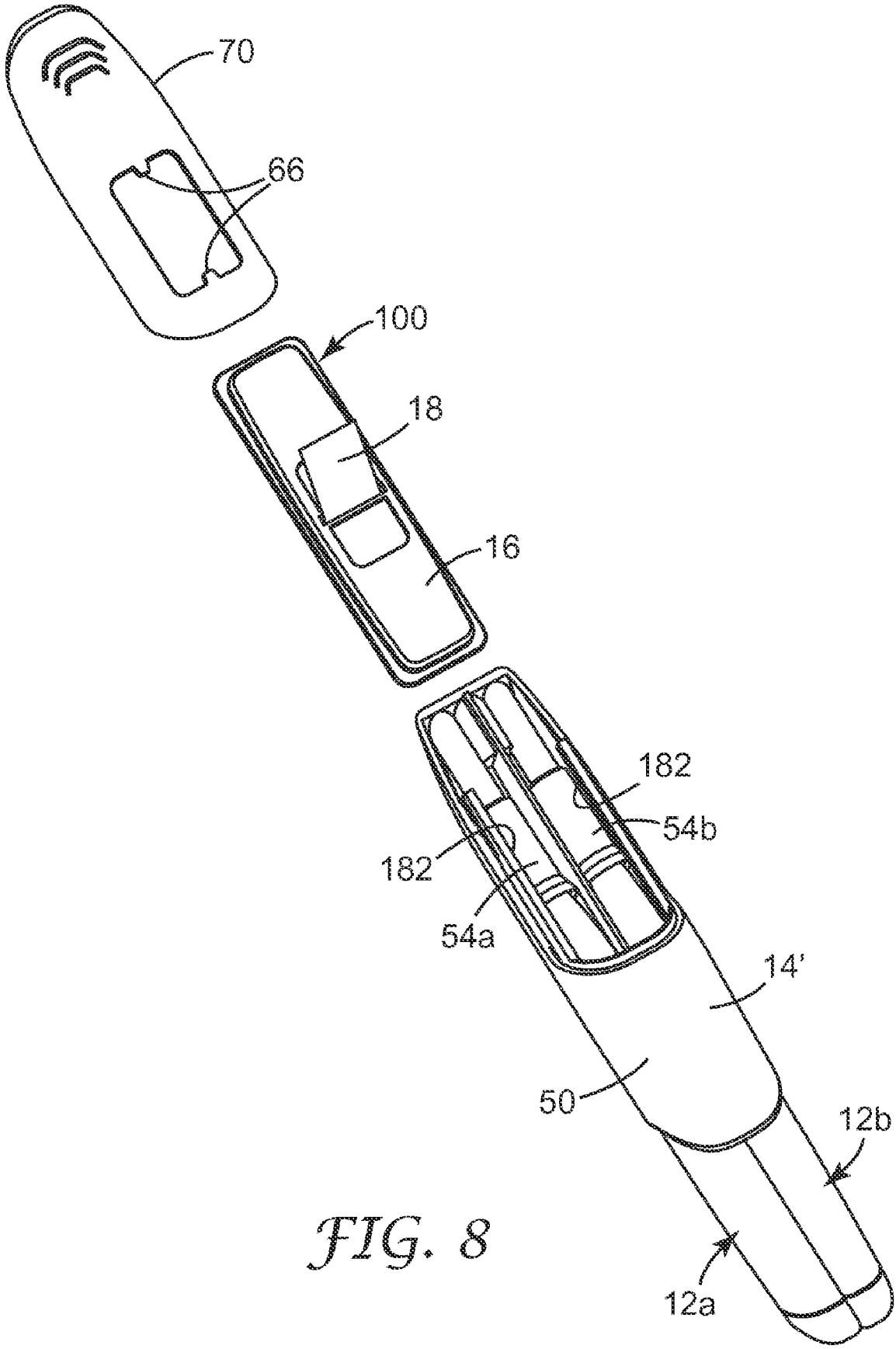
FIG. 8 is a perspective partially exploded illustration of the marking device of FIG. 7, showing the writing instruments engaged with the cap and the cover and stack of sheet material separated from the cap.
Figure 9:
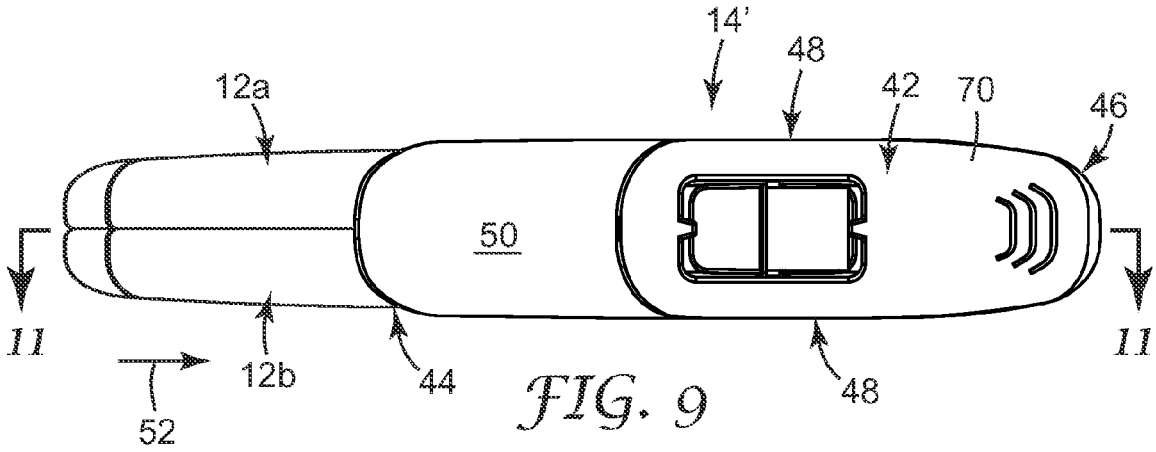
FIG. 9 is a top plan illustration of the marking device of FIG. 7
Figure 10:
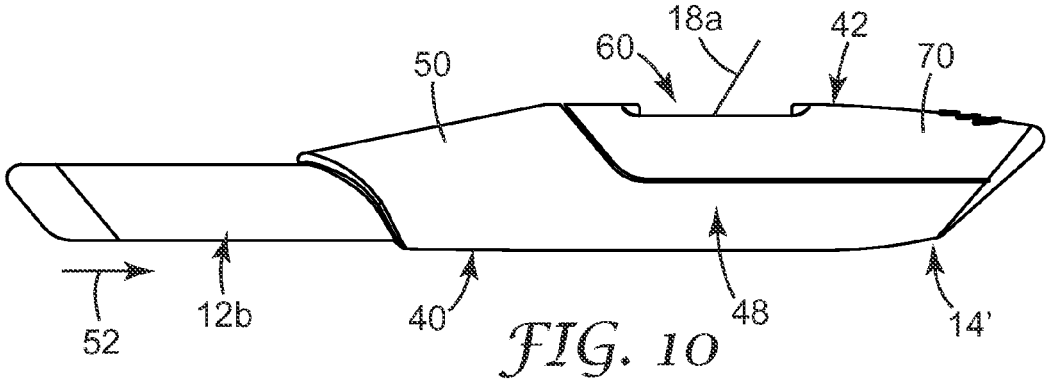
FIG. 10 is a side elevation illustration of the marking device of FIG. 7.
Figure 11:
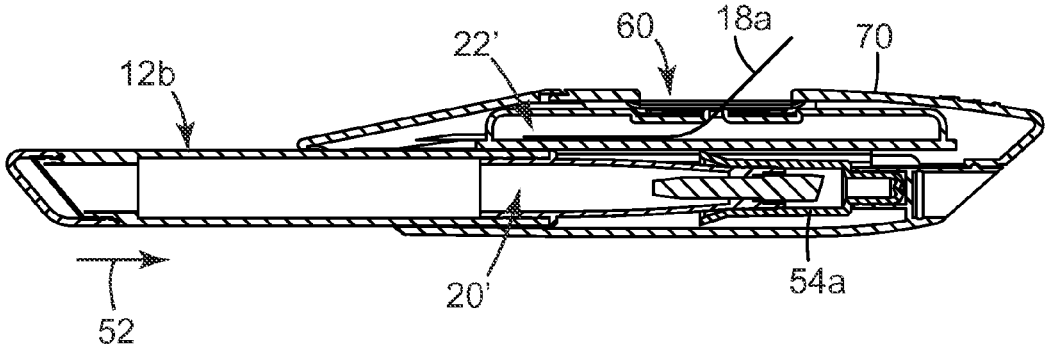
FIG. 11 is a cross-sectional illustration of the marking device of FIG. 4, taken along line 11-11 in FIG. 9.

The top wall 146 is positioned adjacent an uppermost sheet 18 of the stack 16 (which uppermost sheet is identified as 18*a*), with the first end 76 of the uppermost sheet 18*a* of stack 16 projecting through the slot 150. In one embodiment, the top wall 146 and side walls 148 comprise molded plastic, while bottom wall 144 comprises a paper or cardstock material to which the molded plastic top and side walls are secured, as by an adhesive. Bottom wall 144 extends outwardly beyond side walls 148 to form flanges 180 extending from opposed sides of dispenser 100. In one embodiment, flanges 180 extend from opposed longitudinal side walls 148 and are configured to slidably engage mating slots 182 formed in compartment 60 of cap 14 (FIGS. 3 and 8).

The side walls 148 are spaced from the first and second ends 76, 78 of the sheets 18 to afford limited end-to-end movement (e.g. shuttling) of the stack 16 of within the chamber 142 and thus provide relative movement between the slot 150 and the uppermost sheet 18*a*. Thus, when the uppermost sheet 18*a* is dispensed (as described in greater detail below), stack 16 undergoes end-to-end movement.

The relative movement between the portion of the top wall 146 defining the slot 150 and the uppermost sheet 18*a* from an position (FIG. 14) to a final position (FIGS. 15-16) affords, as the uppermost sheet 18*a* is manually pulled through the slot 150, alignment of the slot 150 with successive portions of the uppermost sheet 18*a* toward the second end 78 of the uppermost sheet 18*a* as the successive portions are peeled from an underlying sheet 18 in the stack 16 (identified as 18*b* in FIGS. 14 through 17) to which the uppermost sheet 18*a* is adhered. In the final position (FIGS. 15-16) the slot 150 is located to afford transverse folding of the underlying sheet 18*b* (FIG. 16) at about the juncture between the first and second portions 92 and 94, and movement of the first end portion 92 of the underlying sheet 18*b* through the slot 150 with the second end portion 94 of the uppermost sheet 18*a* to leave, after the uppermost sheet 18*a* is fully peeled from the underlying sheet 18*b*, the first end portion 92 of the underlying sheet 18*b* in a position projecting through the slot 150 in the top wall 146 (FIG. 17) and the underlying sheet 18*b* and the portion of the top wall 146 defining the slot 150 in the initial relative position with respect to each other.

In an alternate embodiment, the dispenser package 100 holding stack 16 may be eliminated, and stack 16 of sheets 18 as described above with reference to FIGS. 14-17 may be inserted directly into compartment 60. In this alternate embodiment, features of dispenser package 100 as described above may be incorporated into window 62 and cover 70. For example, window 83 may be formed to resemble slot 150 of dispenser package 100, and compartment 60 may be formed to resemble or mimic enclosure 140. Carrier member 98 of stack 16 may be made larger than sheets 18 and thus configured to mimic flanges 180 of dispenser 100, and slidably engage slots 182 of compartment 60.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A marking device comprising:

at least one writing instrument comprising a marking element;

a cap defining a writing instrument receiving portion and a sheet dispensing portion, the writing instrument receiving portion inseparable from the sheet dispensing portion wherein said writing instrument receiving portion is configured to cover said marking element when said marking element is not being used; and a substantially flat stack of sheet material releasably retained in the dispensing portion.

2. The marking device of claim 1, further comprising a sheet material dispenser containing the stack of sheet material, the sheet material dispenser releasably retained in the dispensing portion of the cap.

3. The marking device of claim 1, wherein the at least one writing instrument comprises two writing instruments.

4. The marking device of claim 3, wherein at least one of the two writing instruments comprises a highlighter.

5. The marking device of claim 1, wherein the at least one writing instrument comprises at least one of a highlighter, a pen, a dry-erase marker, a permanent marker, and a pencil.

6. The marking device of claim 1, wherein the stack of sheet material comprises sheet material having repositionable adhesive thereon.

7. The marking device of claim 1, wherein the stack of sheet material has a width of about 0.5 inches.

8. The marking device of claim 1, wherein the dispensing portion of the cap defines a compartment having a window to permit a sheet from the stack of sheet material to extend from the compartment therethrough.

9. The marking device of claim 8, wherein the dispensing portion of the cap defines a cover moveable between an open position and a closed position, wherein when the cover is in the open position, the stack of sheet material may be inserted into the compartment.

10. The marking device of claim 9, wherein the cover includes the window.

11. The marking device of claim 9, further comprising a sheet material dispenser containing the stack of sheet material, the sheet material dispenser releasably retained in the compartment, wherein side walls of the compartment define slots configured slidably receive flanges projecting from opposing sides of the sheet material dispenser.

12. The marking device of claim 8, wherein the window defines a perimeter, and further comprising at least one sheet material retaining tab extending from the perimeter to retain the sheet extending through the window below an outer surface of the cap.

13. The marking device of claim 1, wherein sheets of the stack of sheet material each comprising a layer of material having opposite top and bottom major side surfaces and first and second opposite ends, each sheet having a coating of pressure sensitive adhesive on a second end portion of one of the side surfaces adjacent the second end while being free of adhesive on both of the side surfaces on a first end portion thereof adjacent the first end, the sheets being releasably adhered to each other by adhesion of the coatings of pressure sensitive adhesive to form the stack with adjacent ends of the sheets aligned and with the first and second ends of successive sheets in the stack being adjacent.

14. The marking device of claim 13, further comprising:

a carrier member supporting the stack of sheet material, wherein a lowermost sheet of the stack is adhered to the carrier member to restrict movement of the stack relative to the carrier member, the carrier member having transverse side edges substantially parallel to the first and second ends of the sheets; and an enclosure comprising walls defining a chamber in which the carrier member and stack of sheet material thereon are positioned, the walls comprising:

a top wall defining a top side of the chamber, the top wall having a portion defining a generally central transverse slot substantially parallel to the first and second ends of the sheets, the top wall positioned adjacent an uppermost sheet of each of the plurality of stacks with the first end of the uppermost sheet of each stack projecting through the slot;

a bottom wall defining a bottom side of the chamber; and transverse side walls substantially parallel to the first and second ends of the sheets and extending between the top wall and the bottom wall;

wherein the transverse side walls of the enclosure are spaced from the transverse side edges of the carrier member and the first and second ends of the sheets to afford end-to-end movement of the carrier member and stack of sheet material thereon within the chamber.

* * * * *